US006499162B1

(12) United States Patent
Lu

(10) Patent No.: US 6,499,162 B1
(45) Date of Patent: Dec. 31, 2002

(54) POWER-DRIVEN BED

(75) Inventor: Yung-Hsiang Lu, Chiayi (TW)

(73) Assignee: Kuo-Heey Chang, Chiayi (TW)

( * ) Notice: Subject to any disclaimer, the term of this patent is extended or adjusted under 35 U.S.C. 154(b) by 168 days.

(21) Appl. No.: 09/678,790

(22) Filed: Oct. 4, 2000

(51) Int. Cl.[7] ..... A61G 7/015
(52) U.S. Cl. ..... 5/618; 5/616
(58) Field of Search ..... 5/613, 616, 618

(56) References Cited

U.S. PATENT DOCUMENTS

| | | | | | |
|---|---|---|---|---|---|
| 3,593,350 | A | * | 7/1971 | Knight et al. | 5/616 |
| 3,821,821 | A | * | 7/1974 | Burst et al. | 5/616 |
| 6,006,379 | A | * | 12/1999 | Hensley | 5/616 |
| 6,088,853 | A | * | 7/2000 | Jansen | 5/616 |
| 6,101,647 | A | * | 8/2000 | Stroud et al. | 5/613 |

* cited by examiner

*Primary Examiner*—Michael F. Trettel

(74) *Attorney, Agent, or Firm*—Rosenberg, Klein & Lee

(57) ABSTRACT

The present invention relates to a power-driven bed comprising a base, a sliding frame, a power-driven motor, a first, a second, a third, and a fourth bedplate frames, and a first, a second, and a third link bars. The lateral side of the top of such base has a sliding frame, and a power driven motor is mounted on the base; the piston rod of the power-driven motor can be coupled to the sliding frame. The first, the second, the third, and the fourth bedplate frames are aligned horizontally in order, such that these four bedplate frames are coupled at their corresponsive mutual intersections, and the first, the third, and the fourth bedplate frames and both lateral sides of the vase are separately coupled to the first, the second, and the third link bars. A lateral side of the top of the sliding frame is coupled to a lateral side of the second bedplate frame. When the power-driven motor starts, its piston rod pushes the sliding frame forward, and the second bedplate frame will shift forward so that the first, the third, and the fourth bedplate frames operating in connection with the curved movement of the first, the second, and the third link bar accordingly, and generating different inclined angles to meet the user's need for the position of lying down or sitting straight up.

4 Claims, 7 Drawing Sheets

POWER-DRIVEN BED

BACKGROUND OF THE INVENTION

The present invention relates to a power-driven bed, more particularly to a power-driven bed that is able to incline its bedplate to an angle by electric power.

As shown in FIG. 7, a conventional power-driven foldable bed contains a front and a rear bed frame 10, 20 with each lateral side on the top section of the frame and rear bed frames 10, 20 having a front leaning cushion 30 and a rear sitting cushion 40.

The mechanical transmission structure includes a motor, a transmission axle, and a shifting bar. When the bed is in use, the mechanical transmission is initialized to raise the front leaning cushion 30 upward and backward from the front section of the bedside 301 while the rear section fixed. The rear sitting cushion 40 rises to cause the front section 401 and the rear section 402 to incline at an angle. This arrangement gives support to both the back and legs of a user.

However, when in use, the foregoing structure has the following shortcomings:

1. In general, the head of the bed is close to the wall or to the bedside cupboard and lights are installed on the wall or placed on the bedside cupboard for illumination. As the front leaning cushion 30 moves, the rear sitting cushion remains fixed, and the front section 301 moves forwards and backwards, maintaining a distance from the head of the bed and influencing a user's reading by blocking the lights or affecting the illumination. In addition, a user cannot fetch or place objects on the bedside cupboard.
2. After the front section 301 of the front leaning cushion 30 moves upward and backward until it is vertical, the front section 301 of the rear sitting cushion 40 will also move upwards and backwards to an inclination such that the user will be in an uncomfortable position because the user will be sitting in a straight position or have the legs bent or compressed too much. In addition, some of the conventional power-driven beds uses two sets of electric motors and a mechanical transmission structure to control the propping and the inclination of the front leaning cushion and the rear sitting cushion, respectively, which also supports the back and prop the legs of the user.

However, the conventional bed of this sort still bas the following shortcomings.

1. Since it uses two sets of motors and mechanical transmission structures, its cast is more and its structure is more complicated.
2. The two sets of motors and mechanical transmission structures are used to adjust the front leaning cushion and the rear sitting cushion for the propping and inclination. Thus, the operation is cumbersome and time-consuming.

SUMMARY OF THE INVENTION

The objective of this invention is to provide a power-driven bed that comprises a base, a sliding frame, a power-driven motor, a first, second, third, and fourth bedplate frames, and a first, second, and third link bars. The lateral side of the top of such base has a sliding frame, and a power driven motor is mounted on the base. The piston rod of the power-driven motor can be coupled to the sliding frame. The first, second, third, and fourth bedplate frames are aligned horizontally in order such that these four bedplate frames are coupled at their corresponding intersections, and the first, third, and fourth bedplate frames along with both lateral sides of the base are separately coupled to the first, second, and third link bars. A lateral side of the top of the sliding frame is coupled to a lateral side of the second bedplate frame. When the power-driven motor starts, its piston rod pushes the sliding frame forward, and the second bedplate frame will shift forward so that the first, third, and fourth bedplate frames operate in connection with the curved movement of the first, second, and third link bar accordingly, generating different inclined angles to meet the user's need for the position of lying dawn or sitting straight up.

BRIEF DESCRIPTION OF THE DRAWINGS

This invention will be better understood by reference to the accompanying drawings, wherein.

DETAILED DESCRIPTION OF THE PREFERRED EMBODIMENTS

Figure 1:
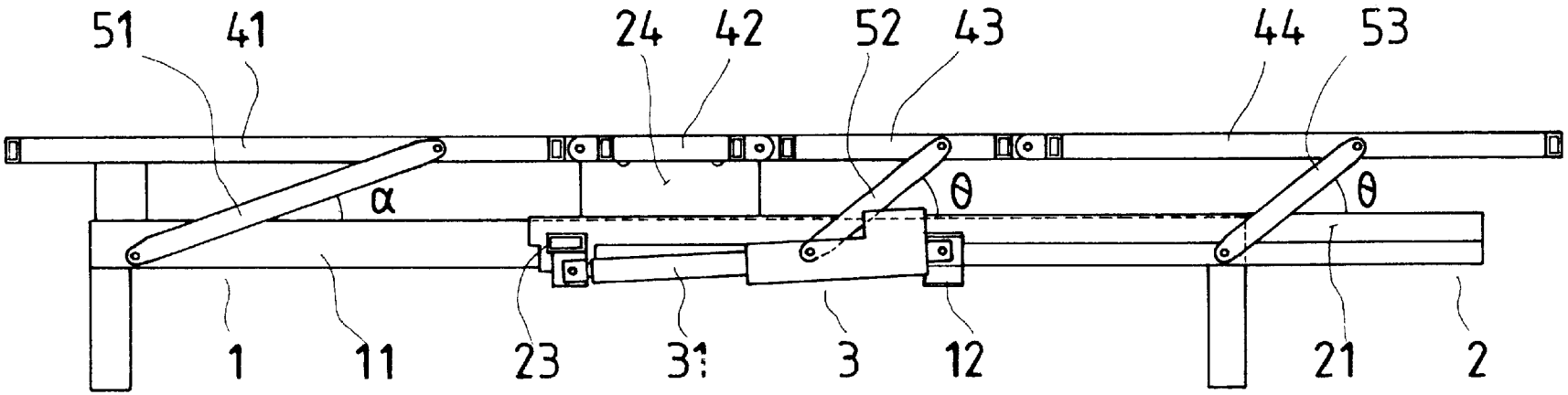
FIG. 1 is a side view of the present invention.
Figure 2:
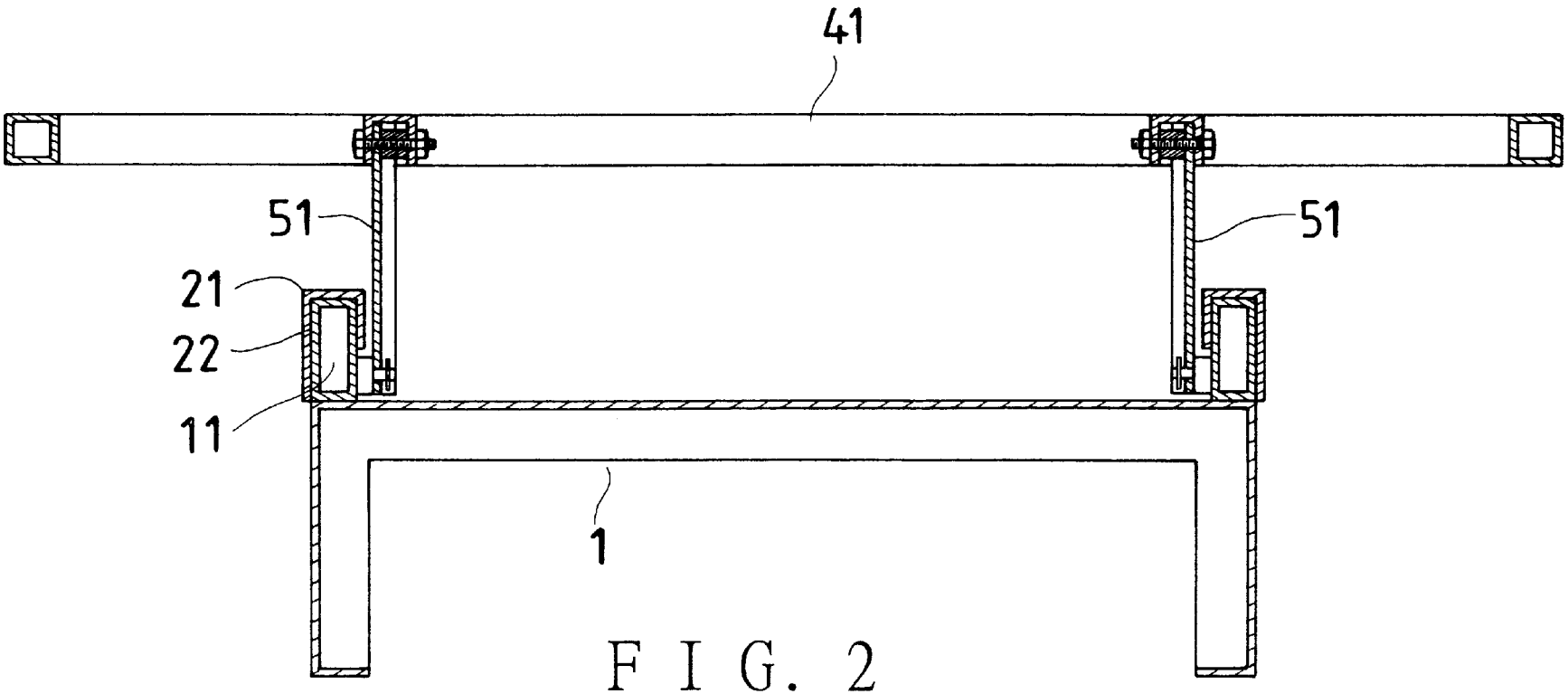
FIG. 2 is a rear cross-sectional view of the present invention.
Figure 3:
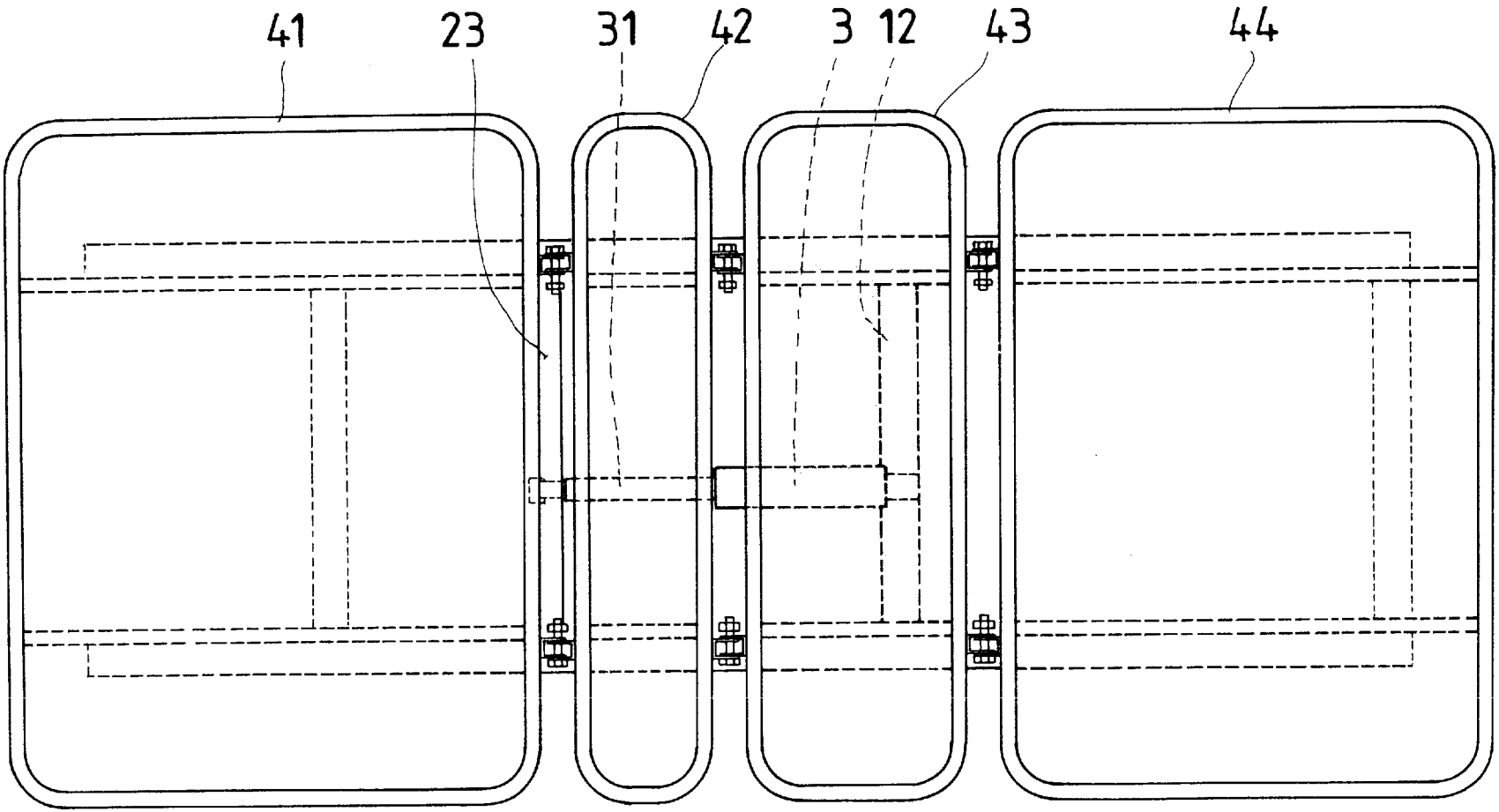
FIG. 3 is a top view of the present invention.

Please refer to FIGS. 1, 2, and 3. The present invention comprises a base 1, a sliding frame 2, a motor 3, a first, second, third and fourth bedplate frames 41, 42, 43, 44, and a first, second, and third link bars 51, 52, 53.

A sliding frame 2 is mounted to the side of the top of the base 1, and an "n"-shaped coupling groove 22 is formed at the bottom of both transversal frames 21 of the sliding frame 2 for sliding on two transversal frames 11 of the base 1. A link frame 23 between two transversal frames 21 of the sliding frame 2 is used for coupling the piston rod 31 of a power-driven motor. The first 41, second 42, third 43, and fourth 44 bedplate frames disposed at the side of the top of the base are aligned horizontally in order such that these bedplate frames are coupled at their corresponding intersections, and the first, third, and fourth bedplate frames along with both lateral sides of the base are separately coupled to the first 51, second 52, and third 53 link bars. A support member 24 is mounted to the top of the sliding frame 2 for coupling the bottom of the second bedplate flame 42.

Figure 4:
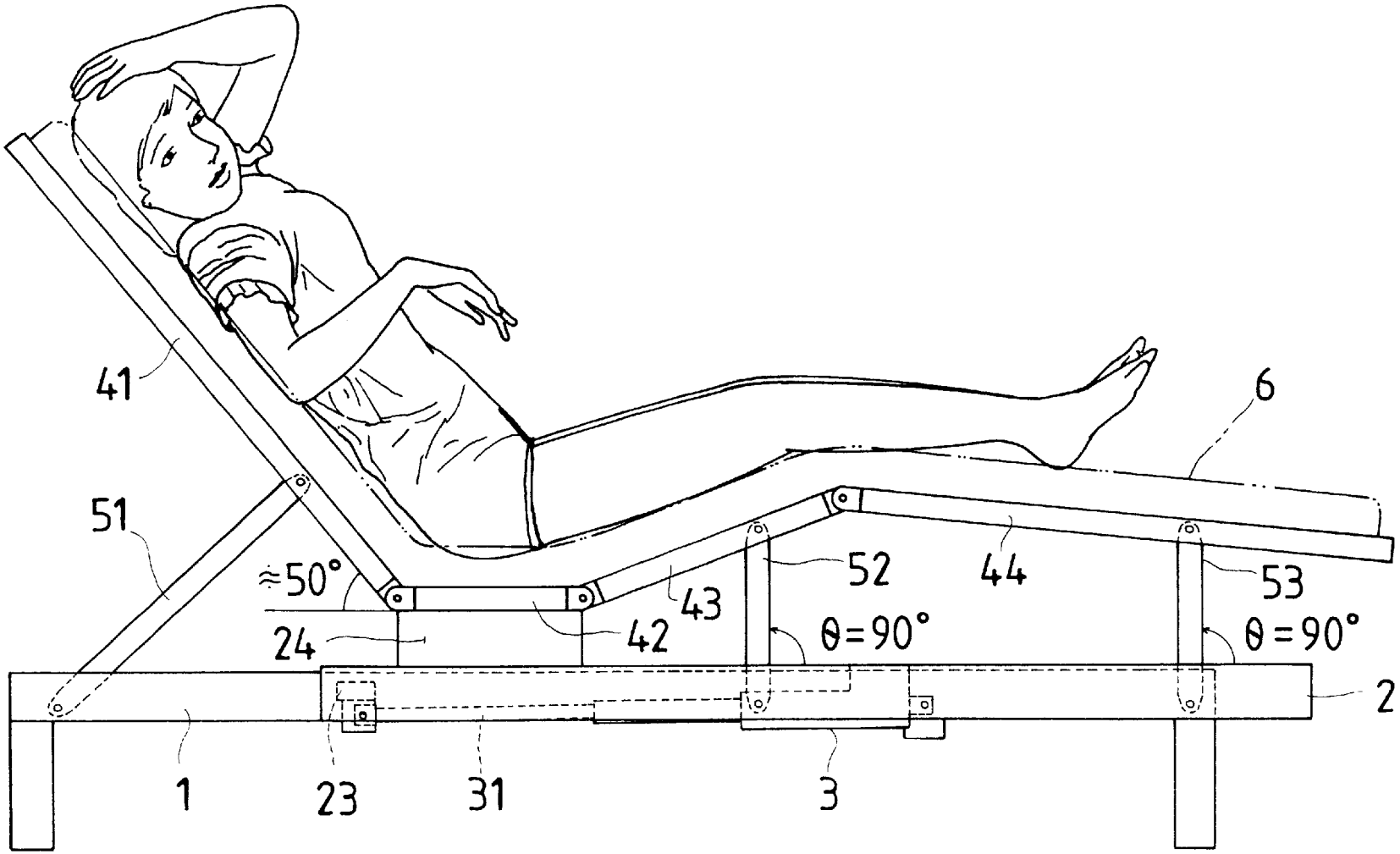
FIG. 4 is a movement according to a preferred embodiment of the present invention.
Figure 5:
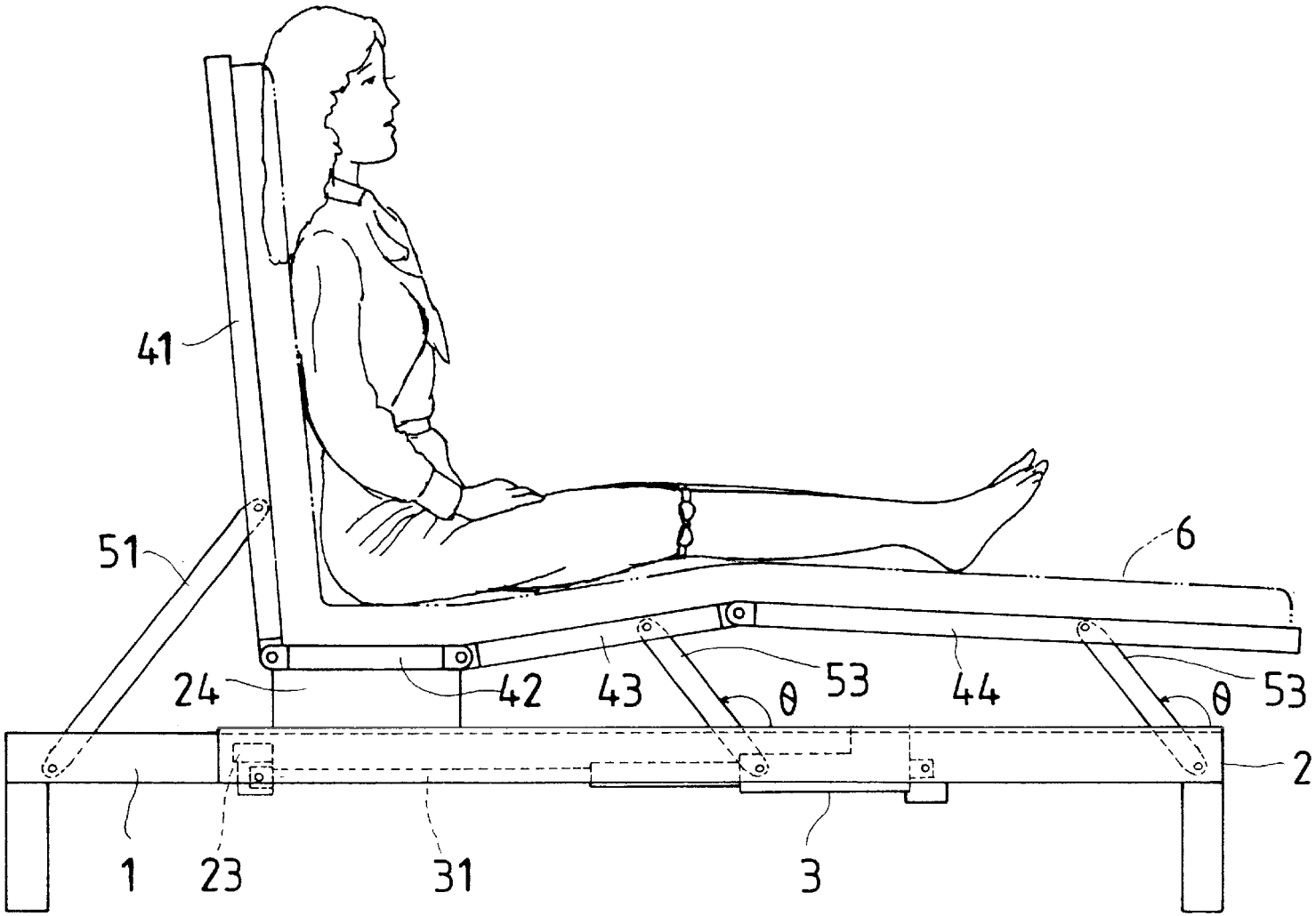
FIG. 5 is another movement according to a preferred embodiment of the present invention.

Please refer to FIG. 4. When the bed is in use, the mattress is disposed on the horizontally aligned bedplate frames 41–44 for the users to lie down or sit straight up.

Figure 6:
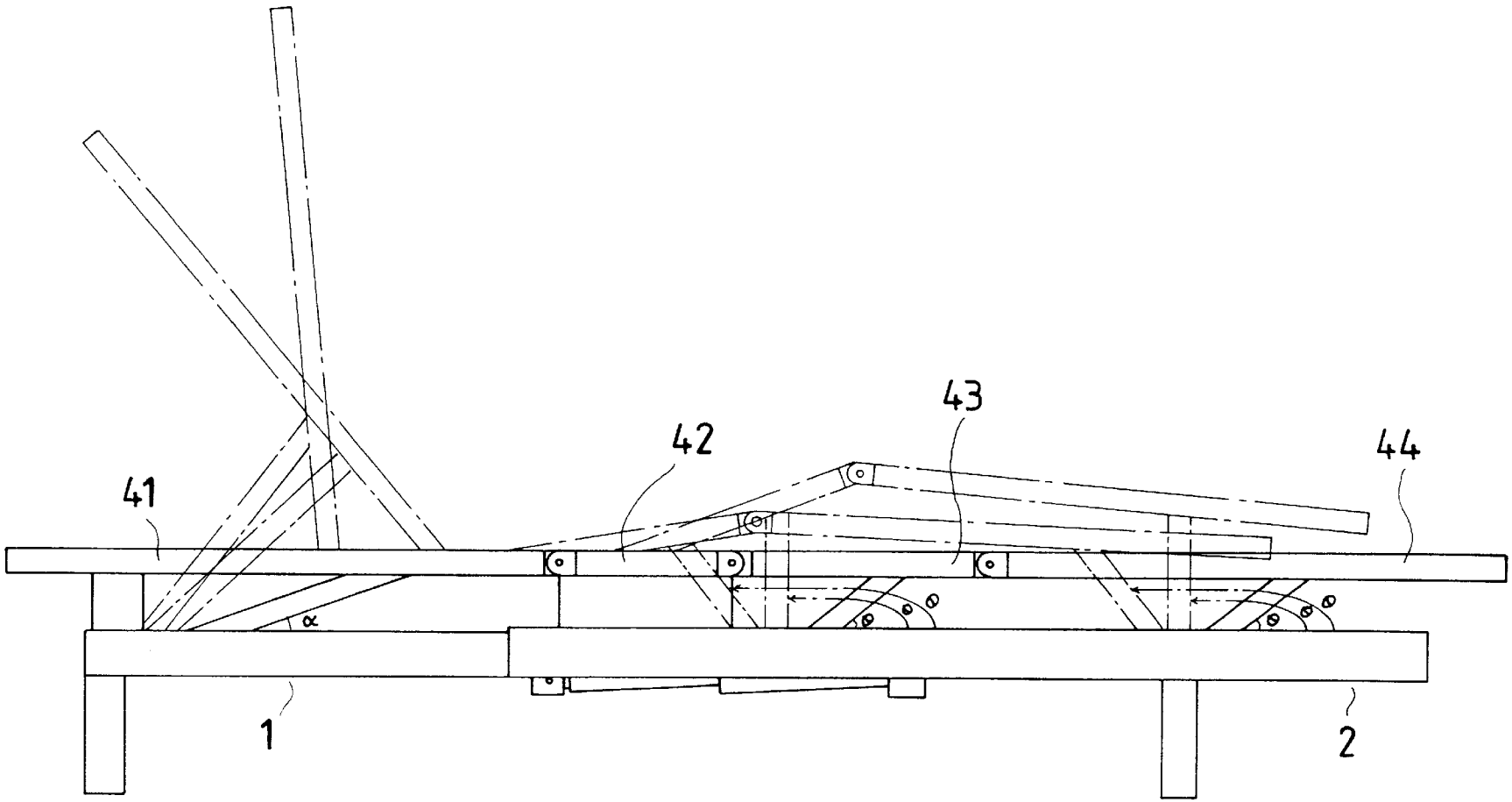
FIG. 6 is an overall movement of lifting the first, second, third, and fourth bedplate frames from a horizontal position according to a preferred embodiment of the present invention.
Figure 7:
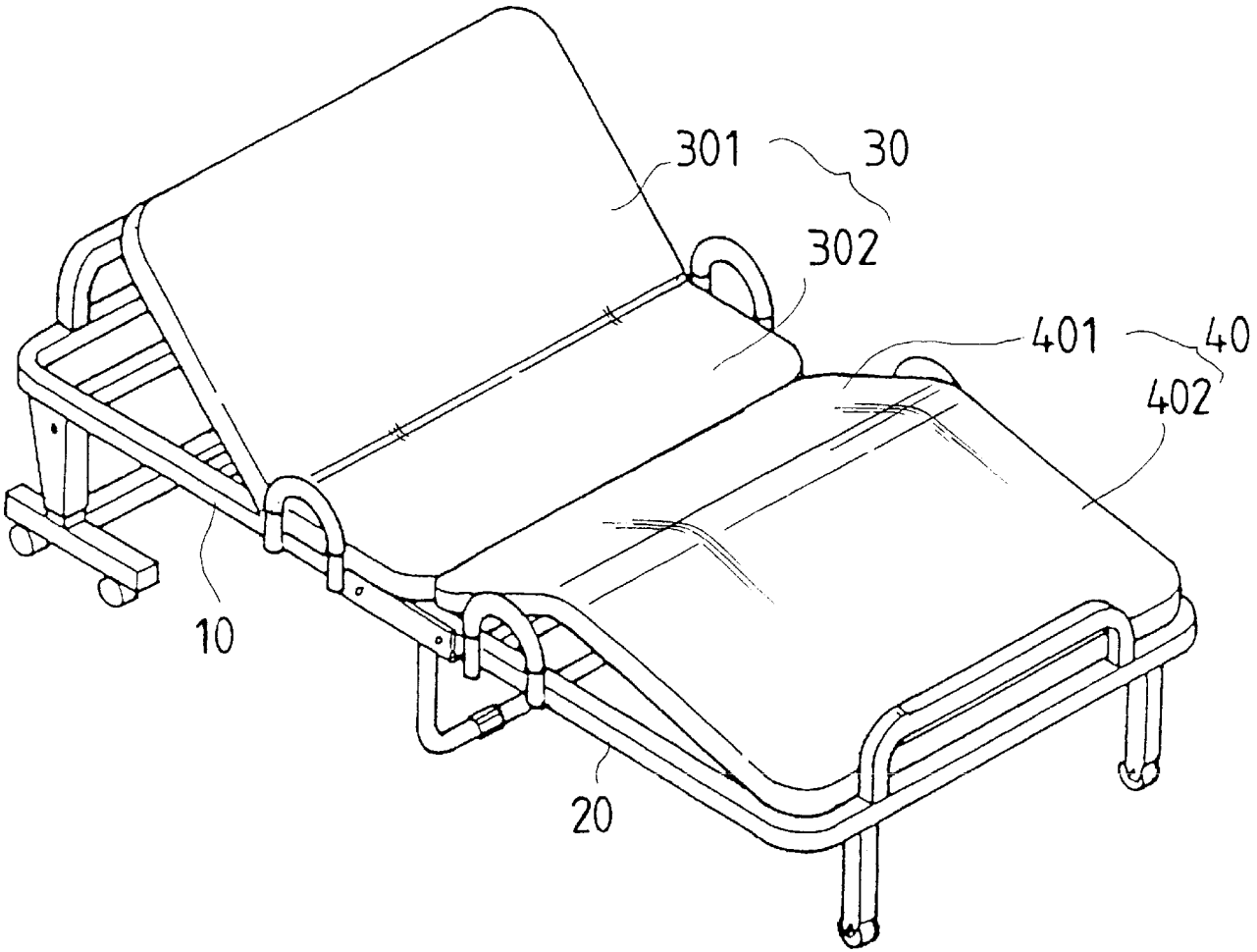
FIG. 7 (PRIOR ART)
FIG. 7 is a perspective view of a prior art.

Please refer to FIG. 1 and FIGS. 4–6. When the frame of the bed is adjusted, the power driven motor starts and pushes the piston rod 31 forward (i.e., in the direction towards the head of the bed) which moves the link frame and in turn shifts the sliding frame 2 and the second bedplate 42 forward. Since the bedplate frames 41–44 are coupled at their mutual intersections, and the first, third and fourth bedplate frames 41, 43, 44, along with the base 1 are coupled by the link bars 51–53, the second bedplate frame 42 shifts forward, and the first, third, and fourth bedplate frames will operate in connection with the curved movement of the first, second and third link bars 51–53 to create a different inclined angle. As shown in FIGS. 1 and 6, at the beginning, the bedplate frames 41–44 are horizontally aligned at the top side of the base 1, and the link bars 51–53 and the transversal frame 11 of the base 1 form the included angle $\alpha$ and $\theta$ which are both acute angles. After the piston rod 31 pushes forward, the included angle $\theta$ of the first to third link bars 51–53 and the transversal frame 11 of the base 1 gradually increases. Meanwhile, the first bedplate frame 41 will gradually move upward and backward (that is in the direction towards the rear of the bed) and tilt due to the propping of the linking bar 51. The third bedplate frame 43 will gradually move upward and backward and then tilt because of the linking of the second link bar 52, and the fourth bedplate frame 44 will move upward and backward and then tilt because of the linking of the third link bar 53, and the included angle between the second and the third bedplate frames 43, 44 will decrease, so that the user can lean his/her back on the first bedplate 41, sit on the second bedplate 42, and bend his/her thigh and tower leg according to the curvature of the third and the fourth bedplates 43, 44. As shown in FIGS. 4 and 6, when the included angles of the second and third link bars 52, 53 with the transversal frame 11 of the base 1 are substantially 90°, the included angle between the third and the fourth bedplate frames 43, 44 are reducing, and both have the largest height. When the included angle between the second and the third link bars 52, 53 and the transversal frame 11 of the base 1 exceeds 90°, and after the first bedplate frame 41 raises and tilts to an angle of about 50°, the third and the fourth bedplate frame 40, 44 will not raise and tilt, but will gradually lower instead. Please refer to FIGS. 5 and 6, the first bedplate 51 will gradually rise to a vertical position, and the included angle between the second, and the third link bars 52, 53 and the transversal frame 11 of the base 1 is obtuse. The third and fourth bedplate frames 43, 44 will lower gradually, and the included angle between the third and fourth bedplate frames 43, 44 will gradually increase. At that time, the user will sit straight up, and both legs bend slightly.

From the foregoing structure, it is known that the present invention has the following advantages:

1. When the first bedplate frame 41 is adjusted to move upward and backward until it tilts, the sliding frame 2 and the second bedplate frame 42 pushes forward to complete such actions. Thus, when the fast bedplate 41 rises and tilts backward, its bottom and the coupling position of the second bedplate 42 will also move forward, therefore after the first bedplate frame 41 is tilted, it still will be close to the bedside cupboard. Therefore, users are able to have a better lighting for reading, and have the convenience to fetch or put their personal items on the bedside cupboard.
2. Please refer to FIGS. 4 and 5. When the first bedplate frame 41 rises and tilts more than an angle of about 50°, the third and fourth bedplate frames 43, 44 will not rise and tilt. On the contrary, it will lower so that the user's back will be raised and tilted, his/her thigh and lower leg will bend more, and after his/her back is tilted to an angle of about 50°, the Legs will lower gradually, and bend slightly. This prevents the uncomfortable feeling from the user's lags being compressed. Therefore, the power driven bed meets the ergonomic requirement.
3. Please refer to FIG. 4. When the first bedplate frame 41 rises and tilts, the third bedplate frame 43 will also till corresponding to the user's thighs. This will prevent the user from sliding because of the inclined first bedplate 41 (in the direction towards the rear of the bed).
4. Only one set of motor and transmission mechanism is used to simultaneously move the first to the fourth bedplate frames 41–44. Therefore it saves cost and time, and has a simple structure for easy operation.
5. The present invention can be used not only as an ordinary bed, but it also provides a comfortable adjustable bedplate for long-hour readers, TV-watchers, and sleepers, and it even acts as a power-driven bed for patients and the elderly people.

What is claimed is:

1. A power-driven bed, comprising:

a base;

a sliding frame laterally mounted on an upper surface of said base;

a power driven motor mounted to said base, said power driven motor including a piston rod, said piston rod being connected to said sliding frame;

four bedplate frames defining a first bedplate fame, a second bedplate frame, a third bedplate frame and a fourth bedplate frame, said bedplate frames being connected to each other and aligned horizontally, respectively, said second bedplate frame having a lateral side connected to an upper lateral side of said sliding frame; and, three link bars defining a first link bar, a second link bar and a third link bar, said first link bar having a first and bring connected to said first bedplate frame and a second end being connected to said base, said second link bar having a first end being connected to said third bedplate being and a second end being connected to said base, said third link bar having a first end being connected to said fourth bedplate frame and a second end being connected to said base, whereby said piston rod forces said sliding frame and said second bedplate frame to shift pivoting said first bedplate frame, said third bedplate frame, said fourth bedplate frame, and said link bars to pivot and generate different inclined angles to meet a user's positioning needs when said power driven motor is activated.

2. The power-driven bed as claimed in claim 1, wherein an n-shaped coupling groove is disposed on a bottom surface of a transversal fame of said base.

3. The power-driven bed as claimed in claim 2, wherein said transversal frame includes a fixed frame and a linking frame, said power driven motor being mounted on said fixed frame, said piston rod being mounted said linking frame.

4. The power-driven bed as claimed in claim 1, wherein a support member is laterally mounted to an upper surface of said sliding frame for connecting said second bedplate frame.

* * * * *